US006658738B1

(12) United States Patent
King

(10) Patent No.: US 6,658,738 B1
(45) Date of Patent: Dec. 9, 2003

(54) PIPE AND TUBING CUTTER

(76) Inventor: Thomas A. King, 272 Glandore Dr., Ballwin, MO (US) 63131

( * ) Notice: Subject to any disclaimer, the term of this patent is extended or adjusted under 35 U.S.C. 154(b) by 0 days.

(21) Appl. No.: 10/000,936

(22) Filed: Nov. 2, 2001

(51) Int. Cl.[7] ..... B26B 13/08; B26B 13/28
(52) U.S. Cl. ..... 30/92; 30/258
(58) Field of Search ..... 30/260, 236, 254, 30/120.4, 92, 199, 194, 226, 115, 330, 196, 177, 258; 81/405, 411

(56) References Cited

U.S. PATENT DOCUMENTS

| | | | | | |
|---|---|---|---|---|---|
| 601,506 | A | * | 3/1898 | Eames | 81/411 |
| 1,344,629 | A | * | 6/1920 | Fowler | 30/177 |
| 1,885,895 | A | | 11/1932 | Carey | 81/328 |
| 1,988,847 | A | * | 1/1935 | Kiefner | 30/258 |
| 3,422,532 | A | | 1/1969 | Ballard | 30/252 |
| 4,269,089 | A | | 5/1981 | Hastings | 81/410 R |
| 4,296,655 | A | | 10/1981 | Tesoro | 81/405 |
| 4,336,652 | A | | 6/1982 | Robertson | 30/258 |
| 4,429,460 | A | | 2/1984 | Hill et al. | 30/90.1 |
| 4,438,669 | A | | 3/1984 | Hastings et al. | 81/410 R |
| 4,581,960 | A | | 4/1986 | Putsch et al. | 81/411 |
| 4,773,288 | A | | 9/1988 | Jang et al. | 81/409.5 |
| 5,461,951 | A | | 10/1995 | Putsch | 81/412 |
| 5,676,029 | A | | 10/1997 | Putsch | 81/412 |
| 5,845,551 | A | | 12/1998 | Putsch | 81/412 |
| 5,904,078 | A | | 5/1999 | Gustafson et al. | 81/417 |

* cited by examiner

*Primary Examiner*—Douglas D. Watts
(74) *Attorney, Agent, or Firm*—Harness, Dickey & Pierce, P.L.C.

(57) ABSTRACT

A cutter adapted for cutting a range of different diameter plastic pipe and tubing with a pair of jaw members pivoted on a pivot pin intermediate their ends with the first of the jaw members pivoted within the second of the jaw members. The first of the jaw members having a knife blade and the second jaw member having a cradle with a cutting cage into which the knife extends. The pivot pin being longitudinally adjustable in the second jaw member for changing the pivot axis.

13 Claims, 5 Drawing Sheets

PIPE AND TUBING CUTTER

BACKGROUND OF THE INVENTION

1. Field of the Invention

The present invention relates to a cutter for use in cutting a range of different diameter plastic pipe and tubing. It will be understood that the utility of the cutter is not limited to "plastic" or to "pipe or tubing", those terms being used in a non-limiting sense to indicate the type of material to be cut not necessarily the identity of the material such that the term "cutter" as used in the subjoined patent claims also includes without limitation a cutter for rubber extrusions and the like.

2. Brief Description of the Prior Art

A cutting tool for cutting plastic pipe and tubing is described in U.S. Pat. No. 4,336,652 to Robertson. The cutter described in this patent is commercially available. For best cutting action, a knife blade should make an angle of about forty-five degrees with respect to the plastic pipe or tubing at initial contact. Since the pivot point of the Robertson cutter is fixed, this can be achieved with different diameter pipe and tubing only by offering the cutter in different sizes. It would be desirable to have a cutter adapted for cutting a range of different diameter plastic pipe and tubing.

The jaw members of a Robertson-style cutter are pivoted open by raking the handle end of the jaw bearing the knife blade across the user's clothing or body. In cutters dimensioned for use in cutting larger diameter pipe and tubing, the knife blade tends to flex making it very difficult or impossible to make a square cut. Other shortcomings of the Robertson cutter include a two-part construction of the jaw with the knife blade.

BRIEF SUMMARY OF THE INVENTION

In view of the above, it is an object of the present invention to provide a cutter which can be used with a range of different diameter plastic pipe and tubing. It is another object to provide a cutter which minimizes blade flexing for a square cut. It is also an object to provide a cutter wherein the angle of initial contact between the knife and the pipe or tubing approaches optimal for commonly available sizes of pipe or tubing. Other objects and features of the invention will be in part apparent and in part pointed out hereinafter.

In accordance with the invention, a cutter for cutting a range of different diameter plastic pipe and tubing has a pair of jaw members pivotally connected intermediate their ends. A first of the jaw members is pivoted on a pivot pin within a second of the jaw members. The first jaw member has a handle at one end and a knife blade extending from the other end. The knife blade has a longitudinal cutting edge. The other of the jaw members has a handle at one end and a cradle with a generally semi-circular cutting cage at the other end into which the knife blade extends. The pivot pin is longitudinally adjustable in the second jaw member for changing the pivot axis of the first jaw member thereby changing the effective cutting cage of the cradle and the angle at which the cutting edge of the knife blade makes on initial contact with the pipe and tubing.

The invention summarized above comprises the constructions hereinafter described, the scope of the invention being indicated by the subjoined claims.

BRIEF DESCRIPTION OF THE SEVERAL VIEWS OF THE DRAWING

In the accompanying drawings, in which one of various possible embodiments of the invention is illustrated, corresponding reference characters refer to corresponding parts throughout the several views of the drawings in which.

DETAILED DESCRIPTION OF THE INVENTION

Figure 2:
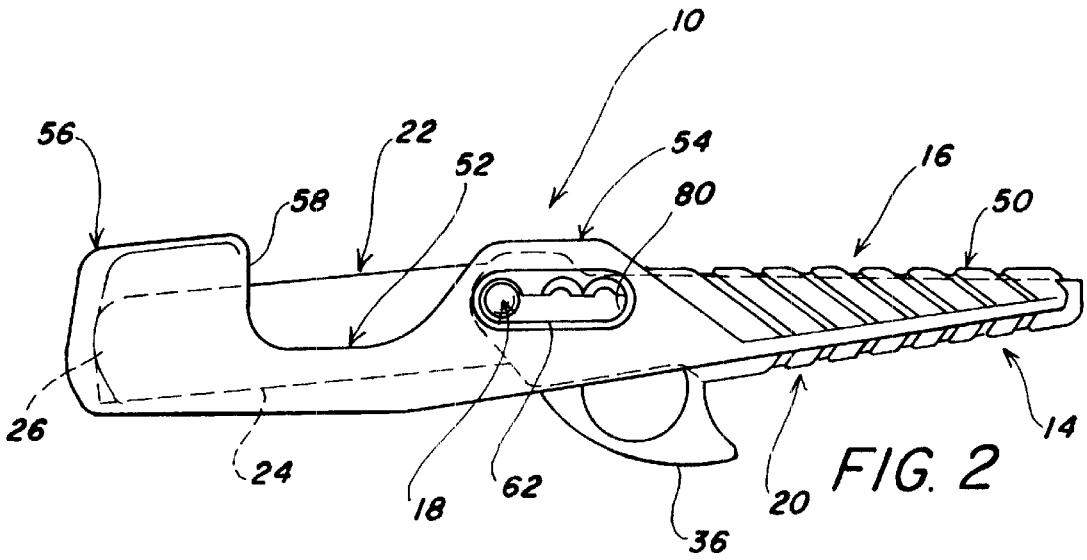
FIG. 2 is a side elevation of the cutter with a first jaw member pivoted within a second jaw member.

Referring to the drawings more particularly by reference character, reference number 10 refers to a cutter for plastic pipe and tubing 12 such as used for water lines. The cutter is adapted for cutting a range of different diameter plastic pipe and tubing, ranging generally from one-half inch to two inch OD. As shown in the drawings, cutter 10 has a pair of elongated jaw members 14, 16 pivotally connected intermediate their ends on a pivot pin 18. As will be described in more detail below, first and second jaw members 14, 16 nest together in a closed position, as shown in FIG. 2.

First jaw member 14 has a handle 20 at one end and a longitudinally extending knife blade 22 extending from the other end. Knife blade 22 has a cutting edge 24 and a blunt or rounded nose end 26. At its heel 28 the blade is mounted in a slot 30 provided in handle 20. Handle 20 is channel-shaped in cross-section with a pair of opposing sidewalls 32 connected by a bottom wall 34. A finger loop 36, trigger or the like is provided on bottom wall 34 serving as a means for pivoting open cutter 10.

Figure 1:
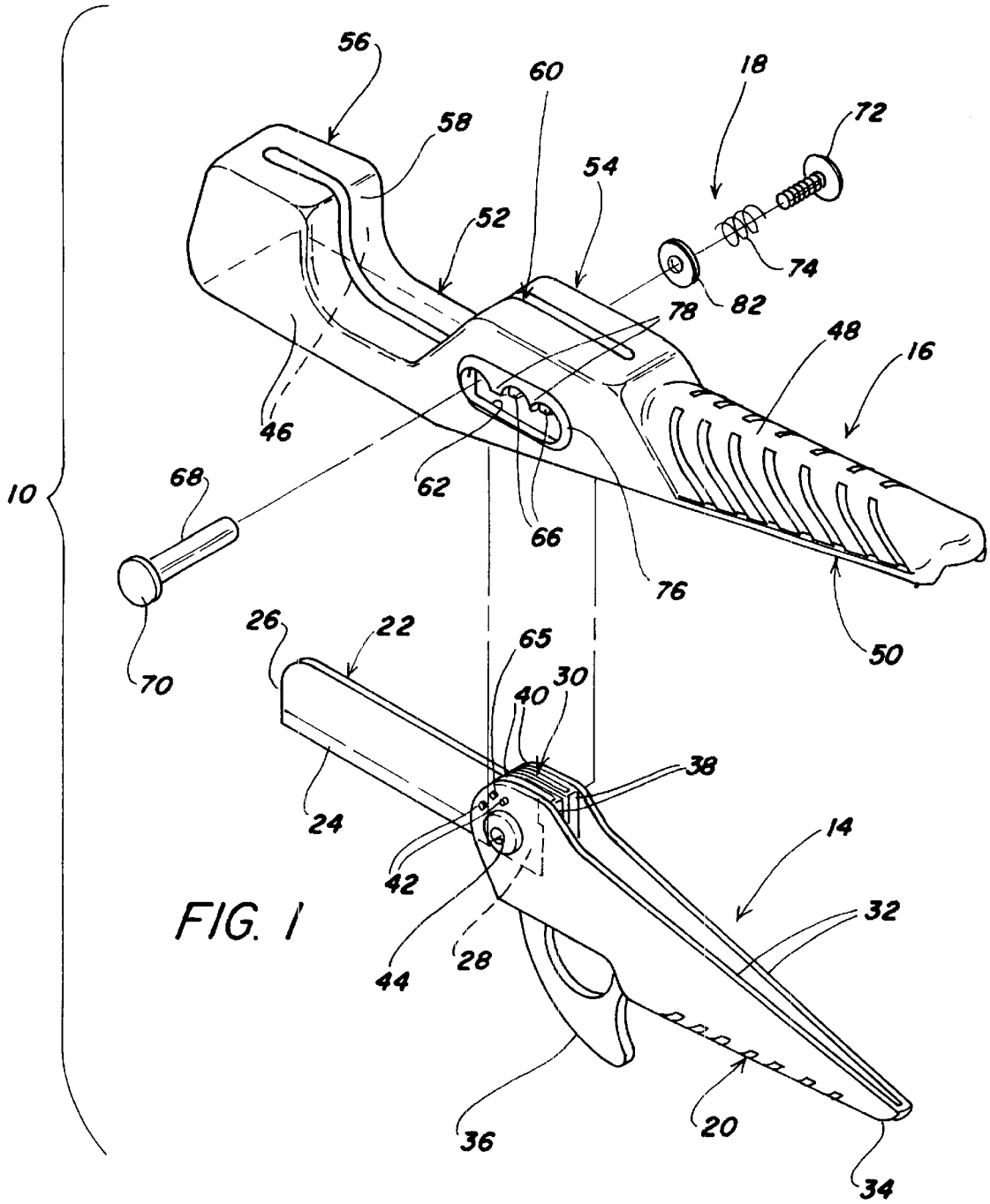
FIG. 1 is an exploded view of a pipe and tubing cutter in accordance with the present invention.

A pair of spaced internal panels 38 and end walls 40 in handle 20 at the knife mounting end define slot 30 for supporting knife blade 22 (FIG. 1). When inserted in handle 20, knife blade 22 is secured in place by roll pins 42, extending through aligned apertures in internal panels 38 and sidewalls 32. For purposes of receiving and retaining pivot pin 18, knife blade 22 is provided at heel 28 with an appropriate aperture in alignment with pivot pin receiving apertures 44 in each of handle sidewalls 32 and internal panels 38.

When knife blade 22 and handle 20 are assembled, the blade is axially aligned with handle 20 with cutting edge 24 downwardly directed. Knife blade 22 is readily replaceable in handle 20 by removing pivot pin 18 and separating first and second jaw members 14, 16. Roll pins 42 are then knocked out and the old knife blade 22 removed. A new blade is inserted, rolls pins 42 are reinserted and jaw members 14, 16 reassembled with pivot pin 18.

Figure 10:
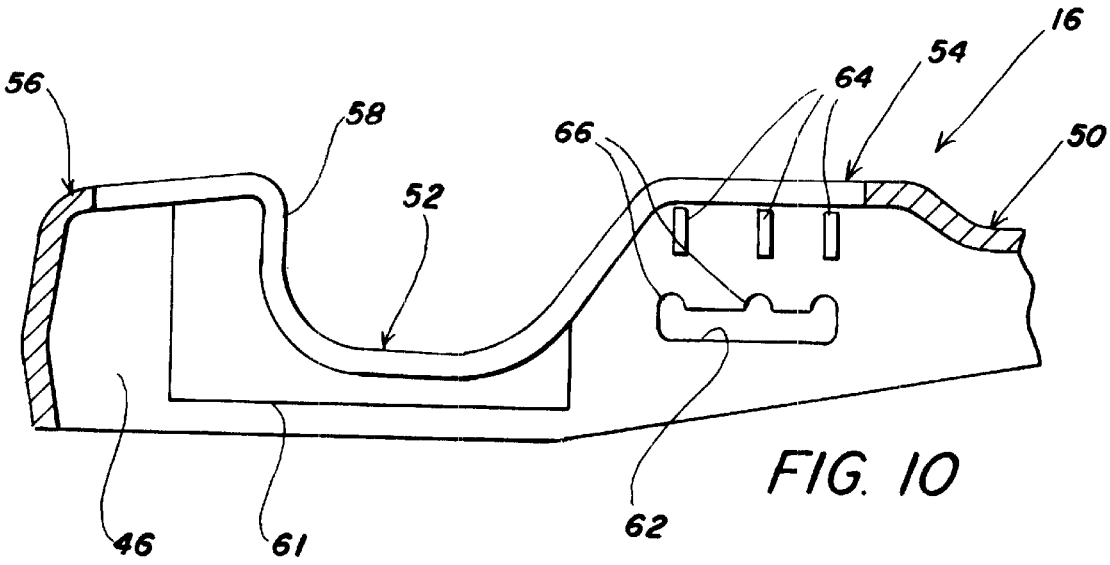
FIG. 10 is a section taken along plane 10—10 in FIG. 9.

Second jaw member 16 is cooperatively associated with first jaw member 14 to form cutter 10. Second jaw member 16 is channel-shaped in cross-section with a pair of sidewalls 46 connected by a top wall 48 organized into a handle 50 at one end and a cradle 52 at the other end integrally joined together with a mounting block 54. Cradle 52 is generally semi-circular in cross-section and extends from handle 50 to an upstanding end wall 56 of second jaw member 16. A forward side 58 of cradle 52 is preferably vertical or hooked rearwardly to better confine pipe or tubing 12 during cutting. To permit knife blade 22 to pass completely through pipe or tubing 12, a knife receiving slot 60 is provided in upstanding end wall 56, cradle 52 and mounting block 54. Reinforcing internal panels 61 (FIG. 10) may line knife receiving slot 60 in cradle 52. In closed position as shown in FIG. 2, knife blade 22 is completely sheathed within mounting block 54, cradle 52 and upstanding end wall 56 with first and second jaw members 14, 16 nested together. Knife blade 22 can pass completely through pipe or tubing 12 to be cut through knife receiving slot 60, thereby ensuring complete severance. Knife receiving slot 60 may chamfered (not shown) along upstanding wall 56 as a blade guide. One or more stop bosses 64, best seen in FIG. 10, may be provided on sidewalls 46 of mounting block 54 for engagement with a nub 65 on the outside of sidewalls 32 of handle 20 of first jaw member 14 to keep the jaw members nested together.

Figure 3:
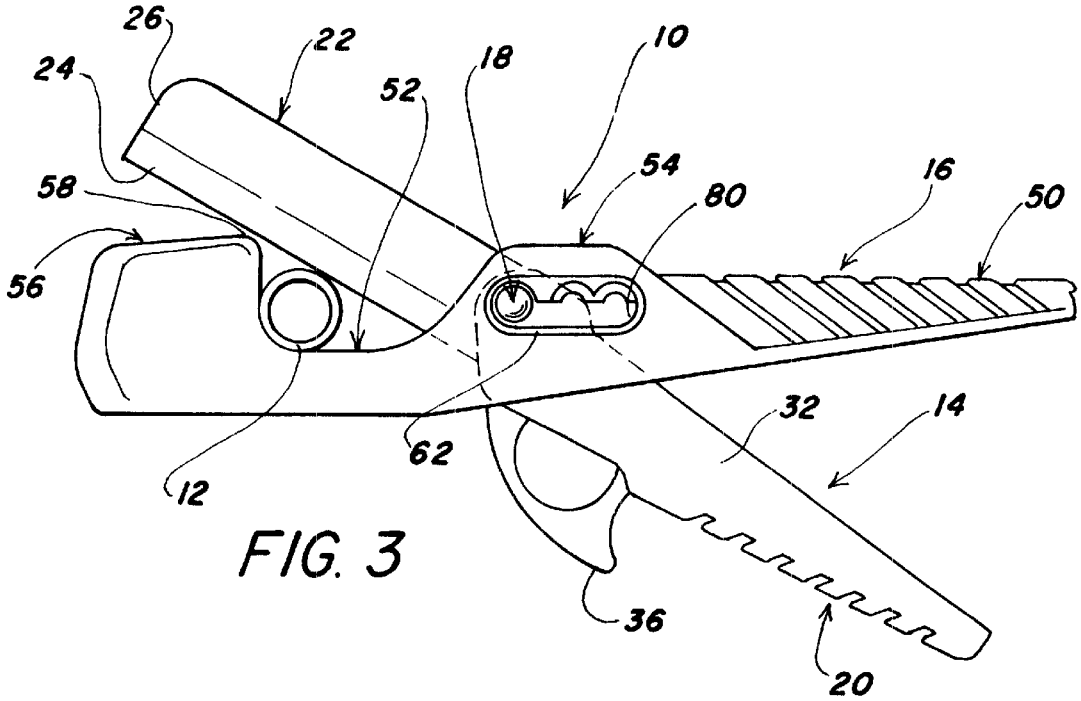
FIG. 3 is a side elevation of the cutter shown cutting a small diameter pipe or tubing with a pivot pin in the forwardmost position and the cutting edge of the knife blade making an angle of about forty-five degrees with respect to the pipe or tube on initial contact.
Figure 4:
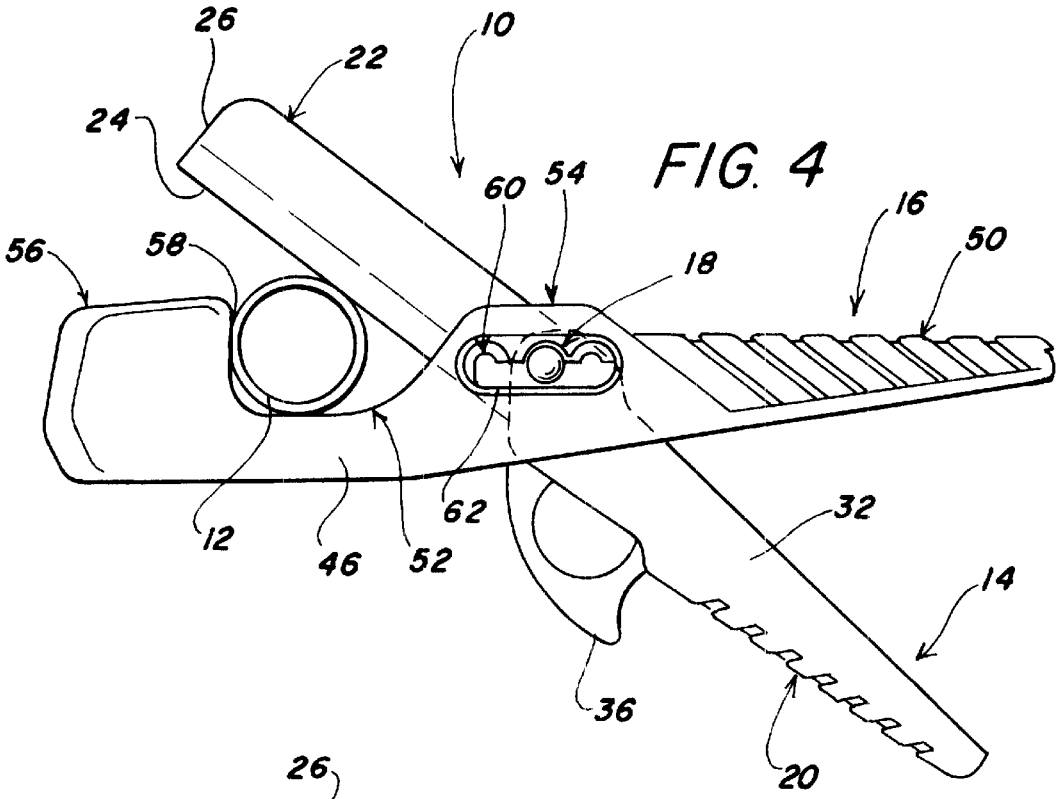
FIG. 4 is a side elevation of the cutter shown cutting a medium diameter pipe or tubing with the pivot pin an intermediate position.
Figure 5:
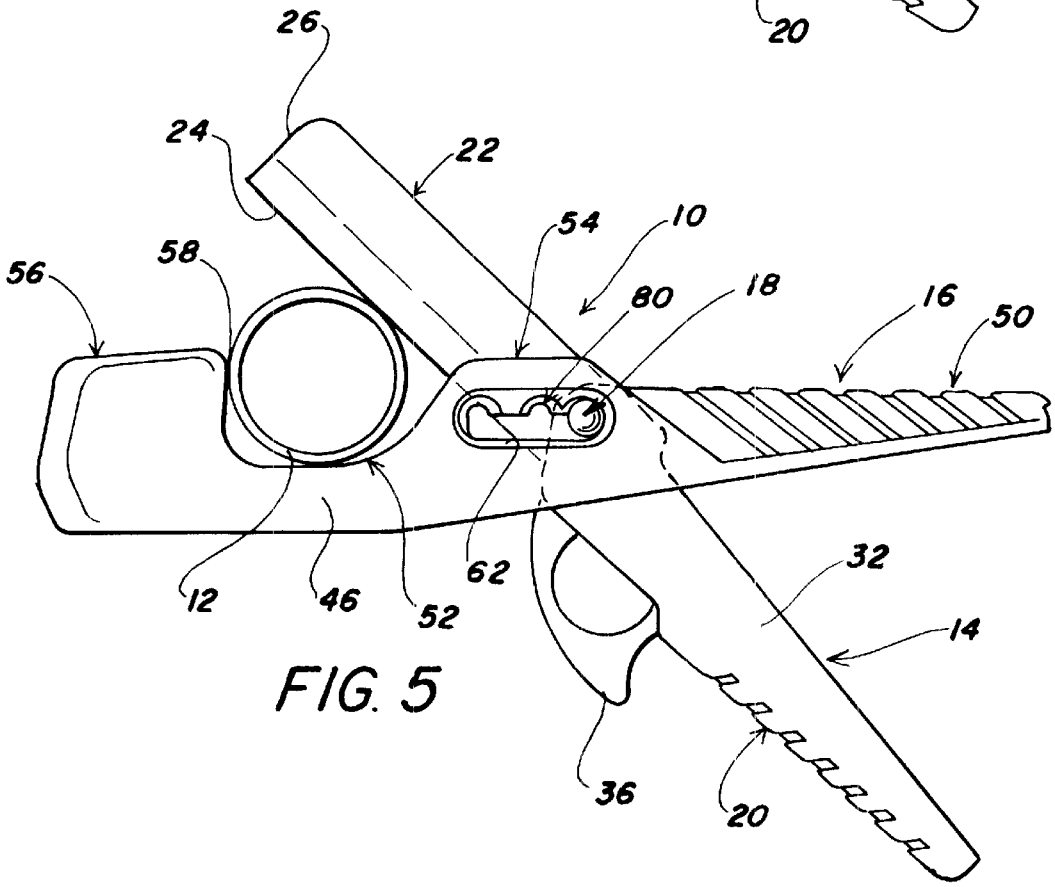
FIG. 5 is a side elevation of the cutter shown cutting a large diameter pipe or tubing with the pivot pin in the rearwardmost position.

Pivot pin 18 is longitudinally adjustable relative to second jaw member 16 for accommodating a range of different diameter plastic pipe and tubing 12 as shown in FIGS. 3–5. For this purpose an elongated slot 62 may be provided in each of sidewalls 46 of mounting block 54. For stepwise adjustment, a plurality of cavities 66 are formed in each elongated slot 62 along one of the longer sides. Corresponding cavities 66 of elongated slots 62 are aligned and adapted to receive pivot pin 18. The pivot axis of knife blade 22 is changed by moving pivot pin 18 between cavities 66. For this purpose, elongated slots 62 accommodate movement of pivot pin 18 in a direction transverse elongated slots 62 a distance sufficient for pivot pin 18 to be unseated from aligned cavities 66 in which it is initially received.

Pivot pin 18 has a shaft 68 with first and second heads 70, 72, respectively, and may be formed of a specialized bolt with a threaded hollow tube extension into which is received a second bolt. By loosening second bolt in threaded hollow tube extension, it is possible to unseat pivot pin 18 from initial cavities 66 in which it is received and permit longitudinal movement between cavities. Once repositioned in aligned cavities, second bolt may be tightened in the threaded hollow tube extension. In the embodiment illustrated in the drawings, a resilient biasing means 74 is provided for biasing first head 70 against first sidewall 46 of mounting block 54. A band 76 may encircle each of elongated slots 62 with lands 78 between cavities 66 on first sidewall 46 forming a recess 80 for receipt of first head 70. Resilient biasing means 74 is illustrated as a coil spring threaded on shaft 68 between second head 72 and second sidewall 46 of mounting block 54. It will be understood that the term "resilient biasing means" includes resilient tubing, rubber bellows and other stock members. A washer 82 may be provided between spring 74 and mounting block 54 for use as a stop for limiting transverse movement of pivot pin 18 in elongated slots 62.

In use, cutter 10 as shown in FIG. 1 is assembled as in FIG. 2. If pipe or tubing 12 has a small diameter, pivot pin 18 is set in forwardmost aligned cavities 66 in sidewalls 46. In this position, cutting edge 24 of knife blade 22 makes about a forty-five degree angle with respect to plastic pipe or tubing 12 at initial contact. This angle of attack is believed optimal but is non-limiting. For pipe and tubing 12 with larger diameters, pivot pin 18 is unseated from initial cavities 66 and moved longitudinally in elongated slot 62 to another of the aligned cavities 66, the particular cavities are preferably selected such that cutting edge 24 makes about a forty-five degree angle with respect to plastic pipe or tubing 12 at initial contact. The effective cutting cage of cradle 52 changes with the position of pivot pin 18. When pivot pin 18 is in the forwardmost aligned cavities 66 as shown in FIG. 3, the effective cutting cage is reduced, better for holding smaller pipe and tubing 12. As pivot pin 18 is moved away from cradle 52, the effective cutting cage increases (FIGS. 4 and 5) for receipt of bigger pipe or tubing 12. It should also be noticed that knife receiving slot 60 in mounting block 54 gives more lateral support to knife blade 22 (FIG. 5), preventing bending, bowing or flexing, when cutter 10 is used for bigger diameter pipe. This helps to ensure that cutter 10 makes a square cut on pipe and tubing 12 of all diameters. While cutter 10 is illustrated in the drawings with three positions for pivot pin 18, it will be apparent that cutter may be provided with more or less cavities 66.

Figure 6:
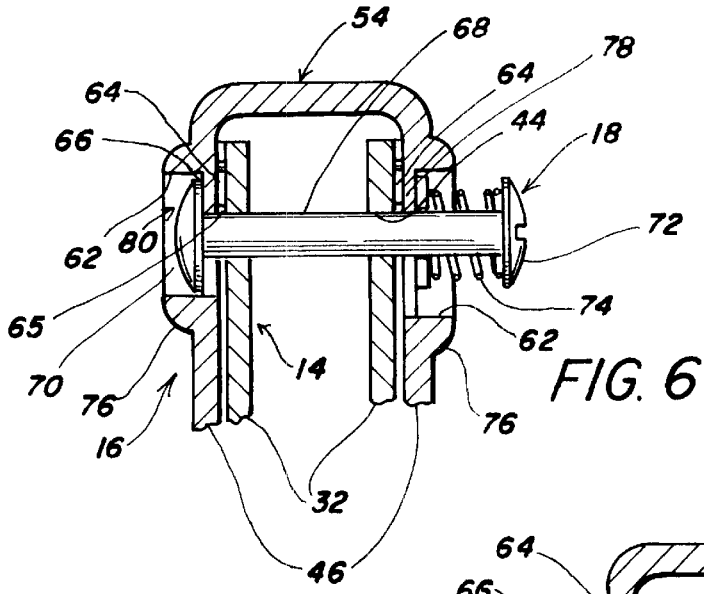
FIG. 6 is detail partly in section taken along plane 6—6 in FIG. 9 and showing a pivot pin with a shaft and first and second heads, with the shaft received in corresponding cavities on opposite sides of the second jaw member.
Figure 7:
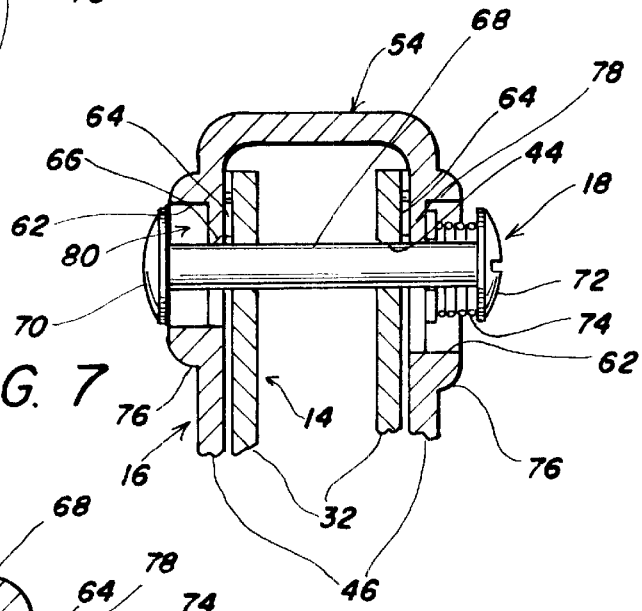
FIG. 7 is a detail similar to FIG. 6 showing the first head unseated from a recess in the second jaw member.
Figure 8:
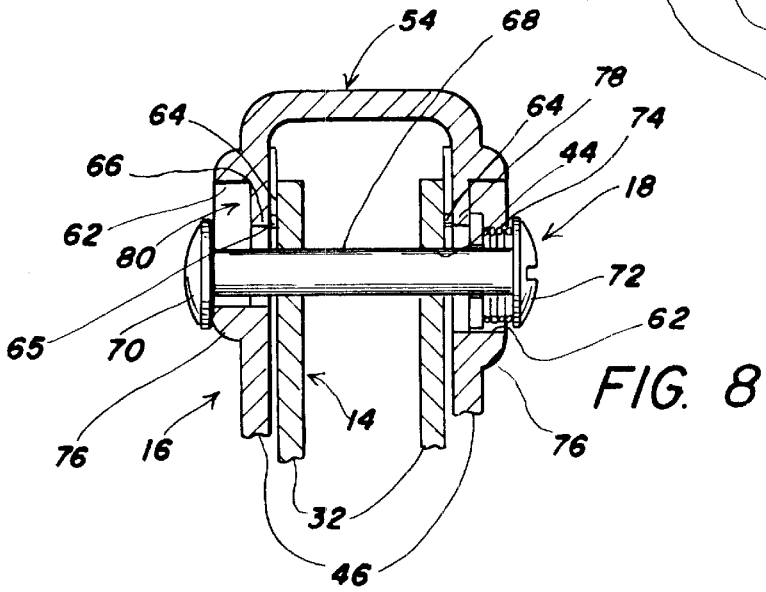
FIG. 8 is a detail similar to FIGS. 6–7 showing the shaft unseated from the initial aligned cavities for longitudinal adjustment in the second jaw member.
Figure 9:
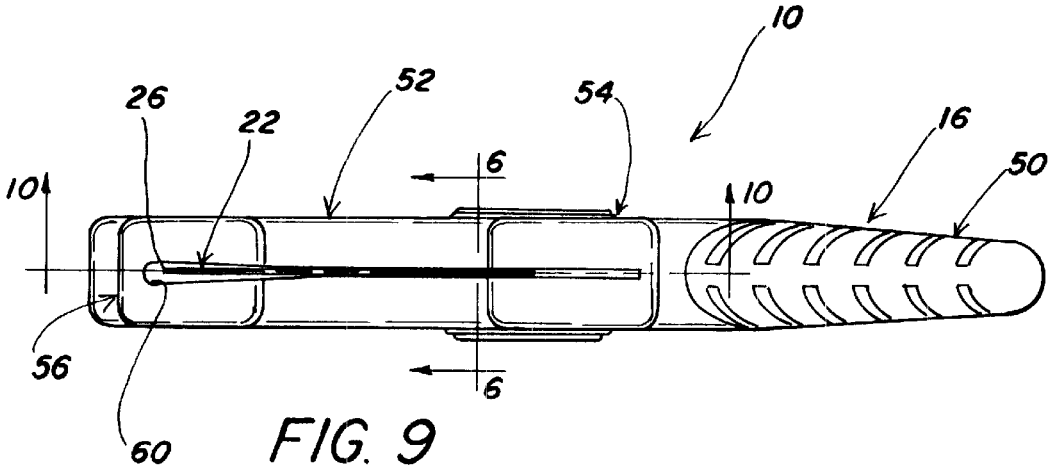
FIG. 9 is a plan view of the cutter.

First head 70 of pivot pin 18 is resiliently biased against sidewall 46 of mounting block 54 as shown in FIG. 6. When a force is applied to second head 72, first head 70 is unseated from recess 80 as shown in FIG. 7. Then, as shown in FIG. 8, shaft 68 may be unseated from initial aligned cavities 66 permitting longitudinal movement of pivot pin 18 to another of aligned cavities, thus changing the pivot axis of first jaw member 14 in second jaw member 16. Cutter 10 may be opened and pivot pin longitudinally adjusted relative to second jaw member 16 with one hand.

In view of the above, it will be seen that the several objects of the invention are achieved and other advantageous results attained. As various changes could be made in the above constructions without departing from the scope of the invention, it is intended that all matter contained in the above description or shown in the accompanying drawings shall be interpreted as illustrative and not in a limiting sense.

What is claimed:

1. A cutter adapted for cutting a range of different diameter plastic pipe and tubing into multiple separate pieces, the cutter comprising a pair of jaw members pivotally connected intermediate their ends, a pivot pin about which a first of the jaw members is pivoted within a second of the jaw members, the first jaw member having a handle at one end and a knife blade extending from the other end opposite to said handle, said knife blade having a longitudinal cutting edge, the other of said jaw members having a handle at one end and a cradle with a generally semicircular non-sharpened cutting cage at the other end into which the knife blade extends, said pivot pin being longitudinally adjustable in the second jaw member for changing the pivot axis of the first jaw member thereby changing the effective cutting cage of the cradle and the angle at which the cutting edge of the knife blade makes on initial contact with the pipe and tubing.

2. The cutter of claim 1 wherein the second jaw member and the handle of the first jaw are channel-shaped in cross section, said channel-shaped handle of the first jaw member opposed to and nested within the channel-shaped handle of the second jaw member when the jaw members are closed together.

3. The cutter of claim 2 wherein the handle and the cradle are integrally joined together by a mounting block and the cradle extends from the mounting block to an upstanding end wall, said cutter having a knife receiving slot in the mounting block, cradle and upstanding end wall and the pivot pin is longitudinally adjustable stepwise in the mounting block.

4. A cutter adapted for cutting a range of different diameter plastic pipe and tubing comprising a pair of jaw members pivotally connected intermediate their ends, a pivot pin about which a first of the jaw members is pivoted within a second of the jaw members, the first jaw member having a channel-shaped handle at one end and a knife blade extending from the other end opposite to said handle, said channel shaped handle having a pair of opposing sidewalls joined by a bottom wall, said knife blade having a longitudinal cutting edge, the other of said jaw members being channel shaped with a pair of opposing sidewalls joined by a top wall and forming a handle at one end and a cradle with a generally semi-circular cutting cage and an upstanding end wall at the other end, said handle and cradle integrally joined together with a mounting block, a knife receiving slot in the mounting block, cradle and upstanding end wall for receiving the cutting edge of said knife blade when said handles are closed together with the channel-shaped handle of the first jaw member opposed to an nested within the channel0shaped second jaw member, said pivot pin being longitudinally adjustable stepwise in the mounting block relative to the second jaw member for changing the pivot axis of the first jaw member thereby changing the effective cutting cage of the cradle and the angle at which the cutting edge of the knife blade makes on initial contact with the pipe and tubing.

5. The cutter of claim 4 wherein an elongated slot is provided in the sidewalls of the mounting block, each of said elongated slots having a plurality of cavities formed along one of the longer sides, the corresponding cavities in the elongated slots being aligned and adapted to receive the pivot pin.

6. The cutter of claim 5 wherein said pivot pin is a shaft with first and second heads, a resilient biasing means for biasing said first head against a first sidewall of the mounting block, a band surrounding each of the elongated slots with lands between the cavities on the first sidewall of the mounting block forming a recess for receipt of said first head.

7. The cutter of claim 6 wherein the resilient biasing means is a coil spring threaded on the shaft between the second head and a second sidewall of the mounting block, said elongated slots accommodating unseating of the shaft from aligned cavities in which the shaft is received and longitudinal movement of the shaft in the slots between the cavities.

8. The cutter of claim 7 wherein a washer is provided on the shaft between the second sidewall of the mounting block and the second head, said washer serving as a stop against the band surrounding the elongated slot on the second sidewall of the mounting block and preventing transverse movement in the elongated slot substantially greater then necessary to unseat the shaft from the aligned cavities in which it is received.

9. A cutter adapted for cutting a range of different diameter plastic pipe and tubing comprising a pair of jaw members pivotally connected intermediate their ends, a pivot pin about which a first of the jaw members is pivoted within a second of the jaw members, the first jaw member having a channel-shaped handle at one end and a knife blade extending from the other end opposite to said handle, said channel shaped handle having a pair of opposing sidewalls joined by a bottom wall with a finger loop for trigger for pivoting open the cutter, said knife blade having a longitudinal cutting edge, the other of said jaw members being channel shaped with a pair of opposing sidewalls joined by a top wall and forming a handle at one end and a cradle with a generally semi-circular cutting cage and an upstanding end wall at the other end, said handle and cradle integrally joined together with a mounting block, a knife receiving slot in the mounting block, cradle and upstanding end wall for receiving the cutting edge of said knife blade when said handles are closed together with the channel-shaped handle of the first jaw member opposed to and nested within the channel-shaped second jaw member, said pivot pin being longitudinally adjustable stepwise relative to the second jaw member for changing the pivot axis of the first jaw. member thereby changing the effective cutting cage of the cradle and the angle at which the cutting edge of the knife blade makes on initial contact with the pipe and tubing.

10. The cutter of claim 9 wherein a forward of said of the cradle is vertical or hooked rearwardly to better confine the pipe or tubing in the cutting cage.

11. The cutter of claim 10 wherein stop bosses are provided on the inside of the sidewalls of the mounting block for engagement with the first jaw member to keep the first and second jaw members nested.

12. The cutter of claim 10 wherein said pivot pin is a shaft with first and second heads, a resilient biasing means for biasing said first head against a first sidewall of the mounting block, a band surrounding each of the elongated slots with lands between the cavities on the first sidewall of the mounting block forming a recess for receipt of said first head, said resilient biasing means being between the second head and the second sidewall of the mounting block, said elongated slots accommodating unseating of the shaft from aligned cavities in which it is received and longitudinal movement of the shaft in the slots between cavities.

13. A cutter adapted for cutting plastic pipe and tubing into multiple separate pieces, the cutter comprising a pair of jaw members pivotally connected intermediate their ends, a pivot pin about which a first of the jaw members is pivoted relative to a second of the jaw members, the first jaw member having a handle at one end and a knife blade extending from the other end opposite to said handle, said knife blade having a cutting edge, the other of said jaw members having a handle at one end and a non-sharpened cutting cage at the other end, said pivot pin being adjustable for changing the pivot axis of the first jaw member relative to the second jaw member thereby changing the angle at which the cutting edge of the knife blade makes on initial contact with the pipe and tubing when said pipe and tubing is positioned in the cutting cage.

* * * * *